US009538789B2

(12) United States Patent
Liu

(10) Patent No.: US 9,538,789 B2
(45) Date of Patent: Jan. 10, 2017

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 603 days.

(21) Appl. No.: 14/056,569

(22) Filed: Oct. 17, 2013

(65) Prior Publication Data

US 2015/0059784 A1 Mar. 5, 2015

(30) Foreign Application Priority Data

Aug. 29, 2013 (CN) ..... 2013 2 0535148 U

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61M 15/06
USPC ..... 131/225
See application file for complete search history.

(56) References Cited

U.S. PATENT DOCUMENTS

2011/0290268 A1* 12/2011 Schennum ..... A24F 47/002 131/330
2013/0192615 A1* 8/2013 Tucker ..... H01C 17/00 131/328
2013/0298905 A1* 11/2013 Levin ..... A24F 47/008 128/202.21
2014/0261493 A1* 9/2014 Smith ..... A24F 47/008 131/328

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

An electronic cigarette is provided, which includes a connection structure between a battery assembly and an atomizer assembly. In the connection structure, a first connection member and a second connection member are connected. The second connection member defines a joint slot for receiving the first connection member. An elastic member includes a bulge radially protruding inward from an inner wall of the joint slot, or radially protruding outward from the first connection member. A buckle slot matched with the bulge is defined in an inner side of the second connection member or is defined in the outer side of the first connection member. The first connection member is inserted in the joint slot and is rotated to press and deform the bulge. When the bulge is rotated to enter the buckle slot, the bulge impacts an inner wall of the buckle slot to generate an indicating sound.

15 Claims, 8 Drawing Sheets

ELECTRONIC CIGARETTE

CROSS-REFERENCE TO RELATED APPLICATIONS

This non-provisional application claims priorities under 35 U.S.C. §119(a) on Patent Application No. 201320535148.6 filed in P.R. China on Aug. 29, 2013, the entire contents of which are hereby incorporated by reference.

FIELD OF THE INVENTION

The present application relates to the field of electrically heating electronic products, and more particularly, relates to an electronic cigarette.

BACKGROUND OF THE INVENTION

An electronic cigarette generally comprises a battery assembly and an atomizer assembly. In the prior art, the atomizer assembly is usually connected with the battery assembly by a threaded connection. However, in the threaded connection method, the battery assembly and/or the atomizer assembly need(s) to be rotated many circles in order to be fixed securely. In the rotating process, if the rotation is not sufficient, the connection may be insecure. On the other hand, if the rotation is excessive, the electronic cigarette may be damaged; however, users cannot hear any indication sound indicating that the rotation is sufficient in the rotating process. Furthermore, conventional connection methods for connecting the battery assembly with the atomizer assembly generally use complex structures and need complicated operations. Thus, electronic cigarettes using the conventional connection methods are generally inconvenient to use, unfavorable for quitting smoking, and have bad user experience.

SUMMARY OF THE INVENTION

The object of the present application is to provide an electronic cigarette, which has a secure connection and in-position indicating ability, aiming at the drawbacks that the connection structure between the atomizer assembly and the battery assembly of the conventional electronic cigarette is complicated and a user can't determine whether the atomizer assembly and the battery assembly are adequately fixed together.

The technical schemes to solve the above technical problems are as follows.

In one aspect, an electronic cigarette is provided, which comprises an atomizer assembly and a battery assembly. A connection structure for connecting the atomizer assembly with the battery assembly is mounted at a joint between the battery assembly and the atomizer assembly. The connection structure includes a first connection member and a second connection member, and the first connection member is connected with the second connection member.

The second connection member defines a joint slot for receiving the first connection member. An elastic member is mounted on the first connection member or the second connection member. The elastic member includes a bulge that radially protrudes inward from an inner wall of the joint slot or radially protrudes outward from the first connection member. Correspondingly, a buckle slot matched with the bulge is defined in an outer side of the first connection member, or is defined in the inner wall of the joint slot of the second connection member.

When the atomizer assembly is connected with the battery assembly, the first connection member is inserted into the joint slot and is rotated to press and deform the bulge. When the bulge is rotated to enter the buckle slot, the bulge impacts an inner wall of the buckle slot to generate an indicating sound and is then buckled in the buckle slot.

In one embodiment, the second connection member includes a jamming base and the joint slot is defined in the jamming base. At least one guiding slot configured to receive the bulge is defined in one side wall of the jamming base. A first step is formed on an inner wall of the jamming base, and the first step is positioned adjacent to the guiding slot and protrudes from the inner wall of the jamming base. The first step and the inner wall of the jamming base cooperatively form the buckle slot. The first step includes a first step plane positioned adjacent to the guiding slot. When the bulge slides along the first step plane and crosses the first step plane to impact the inner wall of the buckle slot, the indicating sound is generated.

In one embodiment, the jamming base has an opening end, and a diameter of the opening end contracts inward to form a limiting step. The limiting step is configured to limit an axial location of the bulge.

In one embodiment, the jamming base defines at least two guiding slots, and a second step is formed between two adjacent ones of the guiding slots. The second step includes a second step plane inclining to the same inclining direction as the first step plane. The first step, the second step, and a portion of the inner wall of the jamming base between the first step and the second step cooperatively form the buckle slot.

In this embodiment, a side surface of the second step which is opposite to the second step plane is coplanar with a side surface of the guiding slot which is away from the first step.

In one embodiment, the buckle slot is a concave spot.

In this embodiment, a buckle ring is formed on the outer side wall of the first connection member. The buckle ring is positioned at a side of the elastic member which is away from the second connection member or a side of the buckle slot which is away from the second connection member. A guiding surface matched with the shape of the buckle ring is formed on an opening end of the second connection member. The buckle ring is inserted in the joint slot via the guiding surface. The bugle is received in the buckle slot and the buckle ring is buckled in the joint slot after the first connection member is rotated.

In one embodiment, the elastic member mounted on the first connection member is an elastic piece with an annular structure. The bulge is a ridge radially protruding outward from the elastic piece. When the first connection member is inserted into the joint slot, the ridge is pressed to deform and then impacts the inner wall of the buckle slot defined in the joint slot to generate the indicating sound.

In this embodiment, a buckle convex block is formed on the outer side wall of the first connection member. The buckle convex block is positioned at a side of the elastic member which is away from the second connection member or a side of the buckle slot which is away from the second connection member. The buckle convex block is inserted in the second connection member and is then limited within the joint slot after being rotated.

In this embodiment, the first connection member includes a first outer electrode configured to enable the electrical connection between the atomizer assembly and the battery assembly. A first through hole configured to enable the ridge to stretch out is defined in one side wall of the first outer electrode. The elastic member is mounted inside the first outer electrode. The ridge runs through the first through hole and protrudes from the outer side of the first outer electrode.

In one embodiment, a first inner electrode configured to enable the electrical connection between the atomizer assembly and the battery assembly is inserted in the first outer electrode. A first insulating member is disposed between the first inner electrode and the elastic member. And a diameter of an outer side wall of the first insulating member contracts to form an annular groove for mounting the elastic member.

In this embodiment, the elastic member is an elastic block fixed on and protruding from the outer side wall of the first connection member or the inner side wall of the second connection member.

In this embodiment, a buckle convex block is formed on the outer side wall of the first connection member. The buckle convex block is positioned at a side of the elastic member which is away from the second connection member or a side of the buckle slot which is away from the second connection member. The buckle convex block is inserted in the second connection member and is then limited within the joint slot after being rotated.

In this embodiment, a buckle ring is formed on the outer side wall of the first connection member. The buckle ring is positioned at a side of the elastic member which is away from the second connection member or a side of the buckle slot which is away from the second connection member. A guiding surface matched with the shape of the buckle ring is formed on an opening end of the second connection member. The buckle ring is inserted in the joint slot via the guiding surface. The bugle is received in the buckle slot and the buckle ring is buckled in the joint slot after the first connection member is rotated.

In this embodiment, the elastic block includes a fixed sleeve and the bulge. The bulge is partially sheathed in the fixed sleeve and is movably connected to the fixed sleeve.

In this embodiment, the bulge and the fixed sleeve cooperatively form a receiving cavity. A spring is inserted in the receiving cavity. One end of the spring abuts the bulge, and the other end of the spring abuts a bottom of the receiving cavity. The spring is configured to apply an elastic force to the bulge along a radial direction of the electronic cigarette.

The following beneficial effects will be achieved when implementing the electronic cigarette of the present application. When assembling the electronic cigarette, the elastic member is rotated to impact the buckle slot and produce the indicating sound, so that the situation that the first connection member and the second connection member are adequately fixed together is indicated. Meanwhile, since two steps are disposed between two guiding slots, the elastic member can impact the first step to produce one indicating sound which indicates that the fixing operation is adequate; and after continuous rotation, the elastic member can further impact the second step to produce another indicating sound which indicates that the first connection member can be disconnected from the second connection member right now. In the present application, the connection method uses a simple structure and is convenient to operate.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENTS

Figure 1:
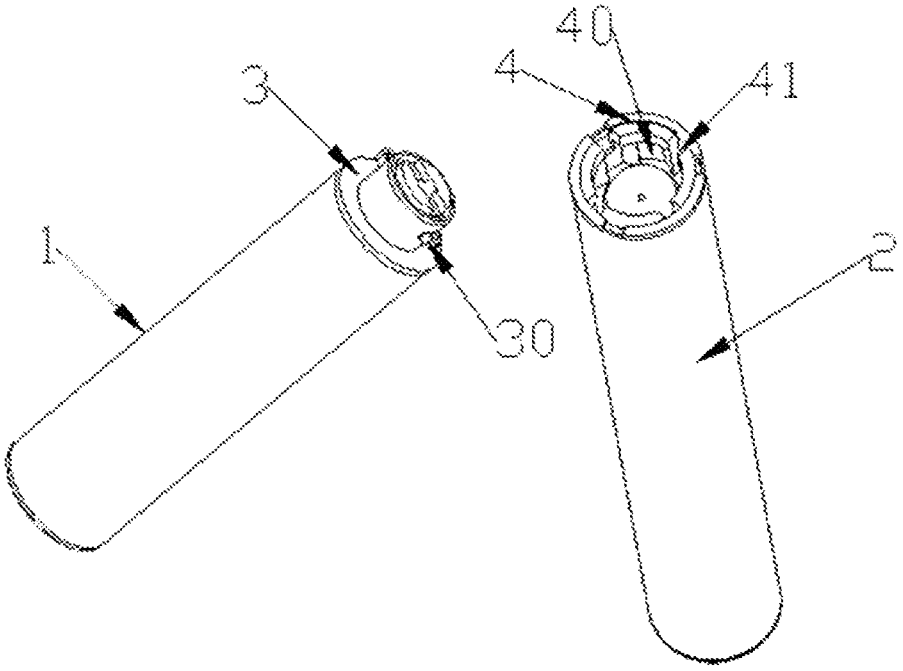
FIG. 1 is a disassembled structural schematic view of an electronic cigarette of a first embodiment of the present application.

To make the objects, technical schemes and advantages more clearly, the present application may be further described in detail with reference to the accompanying drawings and embodiments.

The present application provides an electronic cigarette. Referring to FIGS. 1-8, an electronic cigarette in accordance with a first embodiment of the present application is shown. The electronic cigarette comprises an atomizer assembly 1 and a battery assembly 2 connected together. A connection structure is mounted at a joint between the battery assembly 2 and the atomizer assembly 1. The connection structure includes a first connection member 3 and a second connection member 4, and the first connection member 3 is connected with the second connection member 4. The second connection member 4 defines a joint slot for receiving the first connection member 3. An elastic member 30 is mounted on the first connection member 3 or the second connection member 4. The elastic member 30 includes a bulge 35 that radially protrudes inward from an inner wall of the joint slot or radially protrudes outward from the first connection member 3. Corresponding to the bulge 35, a buckle slot 40 matched with the bulge 35 is defined in an outer side of the first connection member 3 or is defined in the inner wall of the joint slot. A guiding passage is defined in the joint slot. When the atomizer assembly 1 is connected with the battery assembly 2, the first connection member 3 is inserted into the joint slot along the guiding passage, and is rotated to press and deform the bulge 35. When the bulge 35 is rotated to a position corresponding to the buckle slot 40, the bulge 35 restores from the deformation and impacts an inner wall of the buckle slot 40, and finally the bulge 35 is accommodated in the buckle slot 40. In the embodiment, the guiding passage includes guiding slots 41 defined in a side wall of the joint slot. It should be understood that the elastic member 30 can be inserted into the joint slot along the guiding slots 41, and can be pressed and deformed by an inner wall of the joint slot after the elastic member 30 is rotated. If the elastic member 30 is mounted on the inner wall of the joint slot, when the first connection member 3 is inserted into the joint slot and is rotated, the elastic member 30 can be pressed and deformed by the outer side wall of the first connection member 3.

Figure 2:
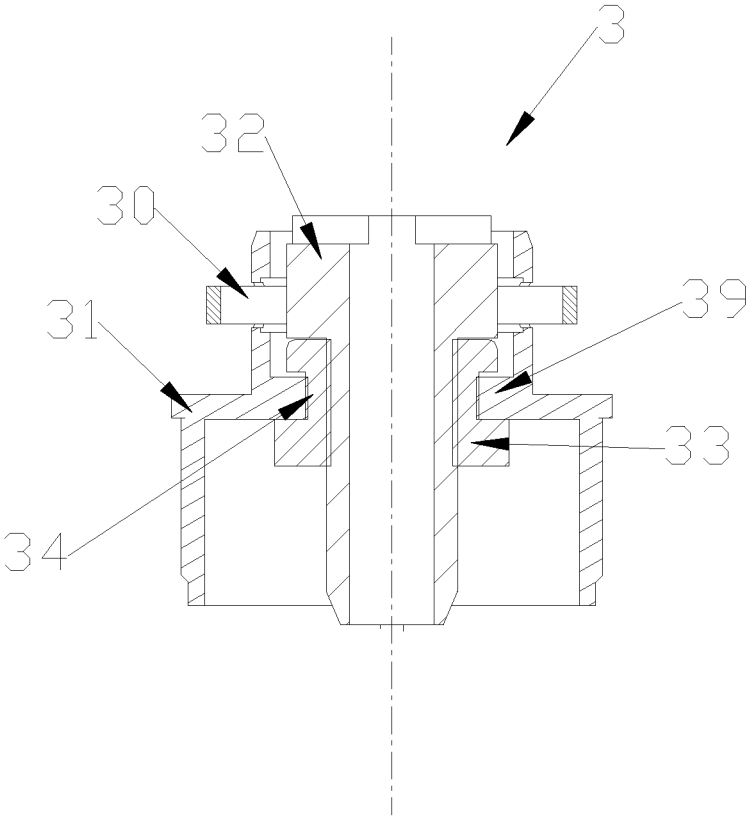
FIG. 2 is a cut-away view of a first connection member of the electronic cigarette shown in FIG. 1.

Referring to FIG. 2, the first connection member 3 includes a first outer electrode 31 and a first inner electrode 32 inserted in the first outer electrode 31. A first insulating member 33 is disposed between the first inner electrode 32 and the first outer electrode 31. In the embodiment, the elastic member 30 is an elastic piece with an annular structure. A ridge radially protrudes outward from a part of the elastic piece, and the ridge serves as the bulge 35 in the disclosure. Referring to FIG. 2, in this embodiment, the first insulating member 33 and the first outer electrode 32 are buckled with each other and fixedly connected together by interference fit. Any adjacent two of the first outer electrode 31, the first insulating member 33, and the first inner electrode 32 are limited by each other.

Referring to FIG. 2, a flange 39 is formed on an inner side the first outer electrode 31. A diameter of an outer side wall of the first insulating member 33 contracts to form an annular groove 34. The first insulating member 33 and the first inner electrode 31 can be relatively fixed by the adoption between the annular groove 34 and the flange 39. The elastic member 30 is mounted in the first outer electrode 31 and surrounds the first inner electrode 32, and the elastic member 30 partially protrudes from an outer side of the first outer electrode 31.

Figure 3:
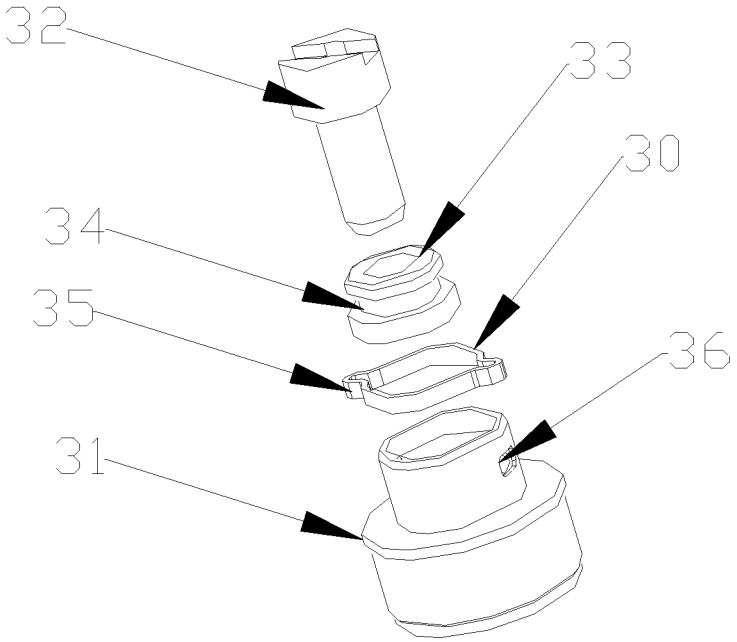
FIG. 3 is an exploded view of the first connection member shown in FIG. 2.

Referring to FIG. 3, a first through hole 36 corresponding to the elastic member 30 is defined in the first outer electrode 31. The elastic member 30 is accommodated in the first outer electrode 31, and the bulge 35 protrudes from the elastic member 30 and stretches out of the first through hole 36. It should be understood that the annular groove 34, which is formed by the contracted outer side wall of the first insulating member 33, can also be configured to mount the annular elastic piece. In this situation, the annular elastic piece sheathes around the annular groove 34, and the bulge 35 protrudes from an outer side of the first outer electrode 31 via the first through hole 36. Meanwhile, one end of the first insulating member 33 which is away from the joint slot abuts the flange 39, and the other end of the first insulating member 33 abuts the first inner electrode 32. Referring to FIG. 3, in this embodiment, each of the first inner electrode 32, the first insulating member 33, and the first outer electrode 31 has a hollow annular structure, which may facilitate the air to flow.

In the embodiment, there are two bulges 25 and two first through holes 36. The two bulges 25 are located at equal intervals, and the two first through holes 36 are located at equal intervals, too.

Figure 4:
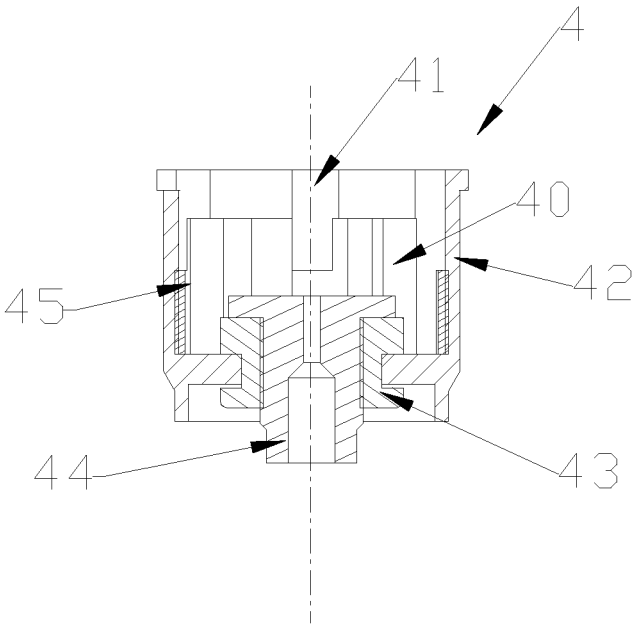
FIG. 4 is a cut-away view of a second connection member of the electronic cigarette shown in FIG. 1.
Figure 5:
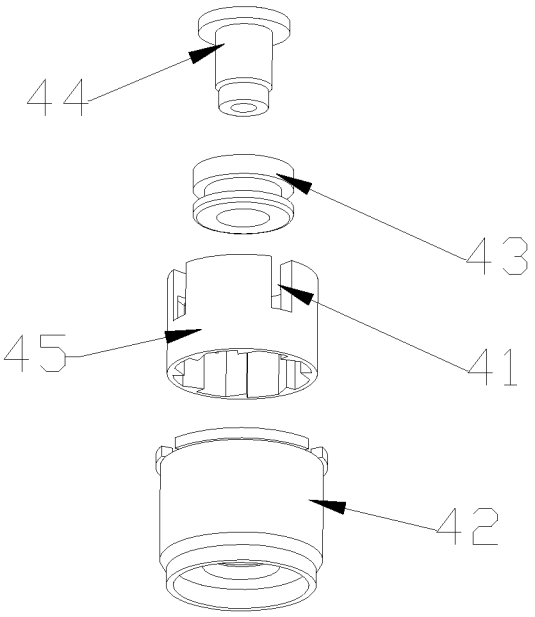
FIG. 5 is an exploded view of the second connection member shown in FIG. 4.

Referring to FIGS. 4-5, the second connection member 4 is shown. In this embodiment, the second connection member 4 includes a second inner electrode 44 that is electrically connected to the first inner electrode 32, and a second outer electrode 42 that is electrically connected to the first outer electrode 31. A second insulating member 43 is disposed between the second inner electrode 44 and the second outer electrode 42. Similar to the structure of the first connection member 3 shown in FIG. 3, the second insulating member 43 and the second outer electrode 42 are buckled with each other and fixedly connected together by interference fit. Any adjacent two of the second outer electrode 42, the second insulating member 43, and the second inner electrode 44 are limited by each other. Besides, in this embodiment, the second connection member 4 further includes a jamming base 45 mounted in the second outer electrode 42. The joint slot is defined in the jamming base 45. The guiding slots 41 are defined in a side wall of the jamming base 45.

Figure 6:
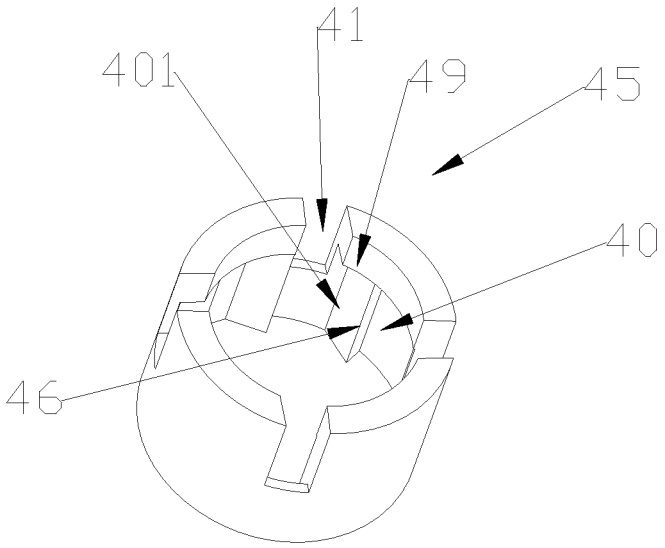
FIG. 6 is a schematic view of a jamming base of the second connection member shown in FIG. 5, in accordance with a first example.
Figure 7:
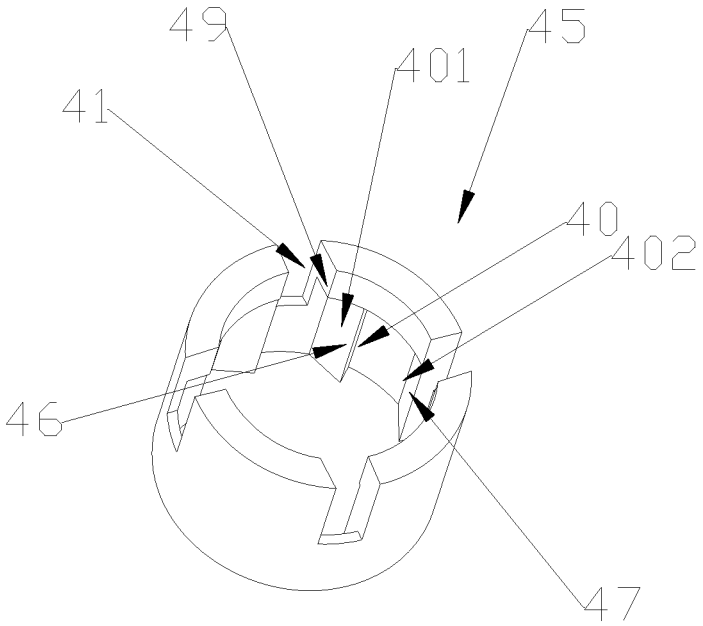
FIG. 7 is a schematic view of a jamming base of the second connection member shown in FIG. 5, in accordance with a second example.

Referring to FIGS. 6-7, implementing examples of the jamming base 45 of the present application are provided. Referring to FIG. 6, in a first example, four guiding slots 41 are defined in the jamming base 45 symmetrically. A first step 46 is formed on a portion of an inner wall of the jamming base 45 positioned between two adjacent ones of the guiding slots 41. The first step 46 includes a first step plane 401 connected to an inner wall of the jamming base 45 aslant. A dihedral angle formed by the first step plane 401 and the inner wall of the jamming base 45 can be 180 degrees, and can also be an obtuse angle. In this way, it is ensured that the bulge 35 can be pressed by the first step plane 401 and can move on the first step plane 401 when the bulge 35 is rotated to reach the first step plane 401. In the first example, the other side of the first step 46, which is opposite to the first step plane 401, is perpendicular to the inner wall of the jamming base 45. It should be understood that a dihedral angle between the other side of the first step 46 that is opposite to the first step plane 401 and the inner wall of the jamming base 45 is not limited to a right angle, and can also be an acute angle. Thus, it is ensured that the bulge 35 can fall down vertically and impact the inner wall of the jamming base 45 to generate an indicating sound when the bulge 35 is rotated to reach the other side of the first step 46 that is opposite to the first step plane 401.

Referring to FIG. 7, in a second example, four guiding slots 41 are symmetrically defined in the circumference of the jamming base 45. A first step 46 and a second step 47 are formed between two adjacent ones of the guiding slots 41. The second step 47 has a second step plane 402 inclining to the same inclining angle as the first step plane 401. Similar to the first step 46, a dihedral angle formed by the other side of the second step 47 that is opposite to the second step plane 402 and the inner wall of the jamming base 45 may be a right angle or an acute angle, which can ensure that the bulge 35 can fall down vertically and impact the inner wall of the jamming base 45 to generate an indicating sound when the bulge 35 is rotated to reach the other side of the second step 47 that is opposite to the second step plane 402. Advantageously, the second step 47 communicates with the guiding slots 41. Therefore, when the bulge 35 is rotated to impact the second step 47 and then generates an indicating sound, a user can disconnect the first connection member 3 from the second connection member 4 along the guiding slots 41.

Figure 8:
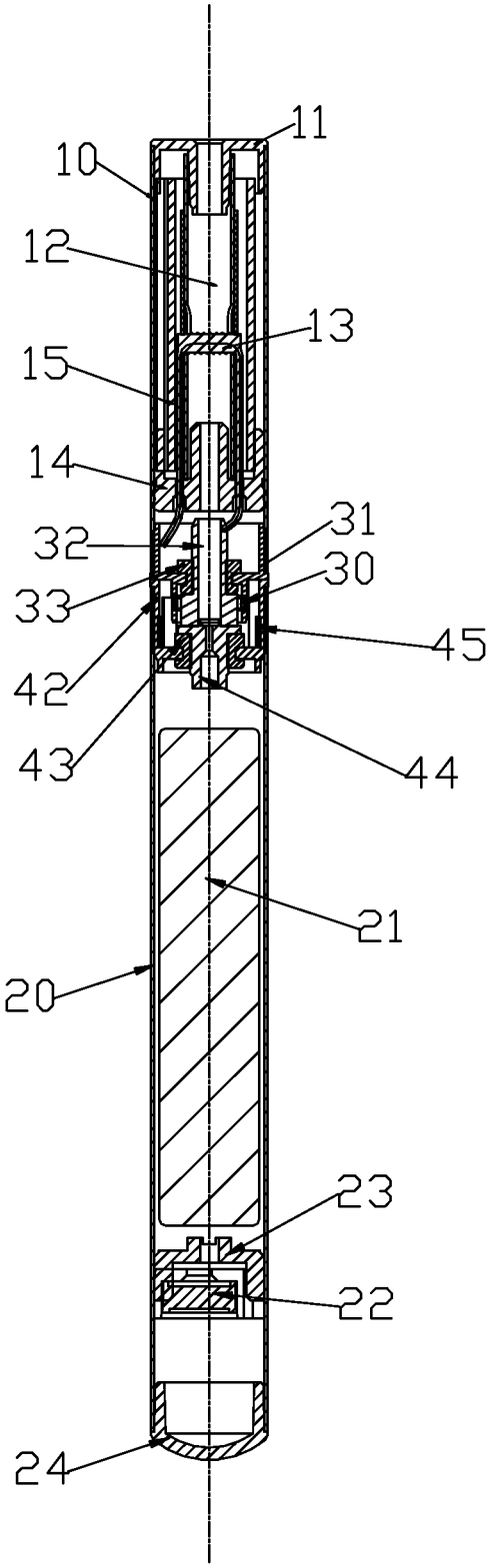
FIG. 8 is an integrally cut-away view of the electronic cigarette of the first embodiment of the present application.
Figure 9:
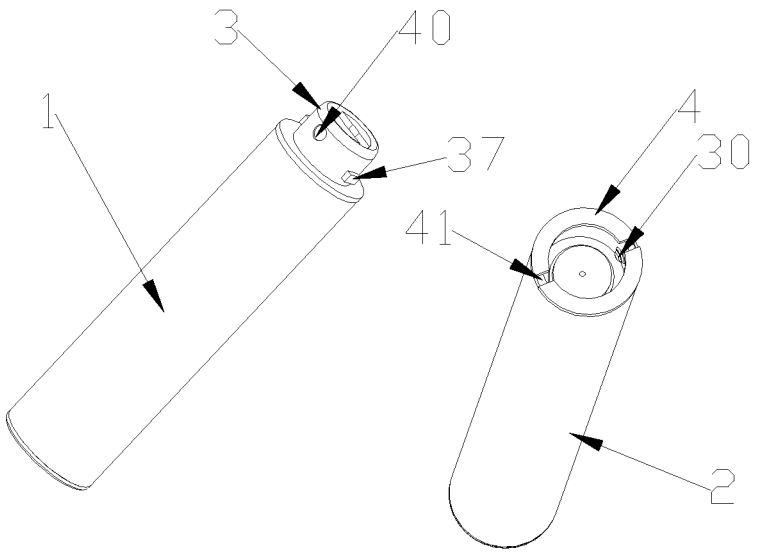
FIG. 9 is a disassembled structural schematic view of an electronic cigarette of a second embodiment of the present application.

Referring to FIG. 8, in this embodiment, the first connection member 3 is buckled at a joint end of the atomizer assembly 1 by an interference fit connection between the first outer electrode 31 and the atomizer sleeve 10 of the atomizer assembly 1, and the second connection member 4 is buckled at a joint end of the battery assembly 2 by an interference fit connection between the second outer electrode 42 and the battery sleeve 20 of the battery assembly 2. The first connection member 3 and the second connection member 4 are connected to each other by a buckling connection between the bulge 35 and the buckle slot 40, and thus the atomizer assembly 1 and the battery assembly 2 are connected with each other. When the atomizer assembly 1 is connected with the battery assembly 2, the first outer electrode 31 and the second outer electrode 42 abuts each other to establish an electrical connection therebetween, and the first inner electrode 32 and the second inner electrode 44 abuts each other to establish an electrical connection therebetween. A nozzle cover 11 is mounted at an end of the atomizer assembly 1 which is away from the first connection member 3. A ventilating pipe 12 and an atomizer base 14 are successively mounted between the nozzle cover 11 and the first connection member 3. An electrical heating wire assembly 13 is radially inserted in the ventilating pipe 12. An oil storing cotton 15 sheaths around the ventilating pipe 12. One end of the electrical heating wire assembly 13 is electrically connected to the first inner electrode 32, and the other end of the electrical heating wire assembly 13 is electrically connected to the first outer electrode 31. The second connection member 2 is buckled at an joint end of the battery sleeve 20 of the battery assembly 2 by interference fit. An end cover 24 is mounted at an end of the battery sleeve 20 which is away from the second connection member 4. In the direction from the end cover 24 to the second connection member 2, a gas flow sense control assembly 22, a mount base 23 configured for mounting the gas flow sense control assembly 22 thereon, and a battery 21 are successively accommodated in the battery sleeve 20. The second inner electrode 44 is electrically connected to one of a positive pole of the battery 21 and a negative pole of the battery 21, and the second outer electrode 42 is electrically connected to the other of the positive pole of the battery 21 and the negative pole of the battery 21.

It should be understood that the first outer electrode 31 can be inserted in one of the atomizer sleeve 10 of the atomizer assembly 1 and the battery sleeve 20 of the battery assembly 2 by interference fit. Likewise, the second outer electrode 42 can be inserted in the other of the atomizer sleeve 10 of the atomizer assembly 1 and the battery sleeve 20 of the battery assembly 2 by interference fit.

It should be understood that the elastic member 30 may also be a snap spring, a spring wire, or any other elastic elements.

Referring to FIGS. 9-12, an electronic cigarette in accordance with a second embodiment of the present application is shown. In the second embodiment, the elastic member 30 is mounted on an inner wall of the joint slot of the second connection member 4. Different from the first embodiment, in the second embodiment, the joint slot is directly defined in the second outer electrode 42, and a diameter of an opening end of the second outer electrode 42 radially contracts inward to form a limiting step 49. In the second embodiment, the buckle slot 40 matched with the elastic member 30 is a concave spot directly defined in a side wall of the first outer electrode 31. At lease one buckle convex block 37 is formed on an outer side wall of the first connection member 3, and the at least one buckle convex block 37 is located at a side of the buckle slot 40 which is away from the second connection member 4. Corresponding to the at least one buckle convex block 37, at least one guiding slot 41 is defined in an opening end of the second outer electrode 42. When the atomizer assembly 1 is connected with the battery assembly 2, each buckle convex block 37 is inserted into the joint slot along a corresponding guiding slot 41, and then the buckle convex block 37 is rotated and limited by the limiting step 49. Meanwhile, the elastic member 30 in the joint slot is pressed and deformed by an outer side wall of the first outer electrode 32 in the rotation process. When the elastic member 30 is rotated to reach the buckle slot 40, the elastic member 30 restores from the deformation. At this time, the elastic member 30 impacts the buckle slot 40 to generate an indicating sound, and the elastic member 30 is accommodated in the buckle slot 40.

Figure 10:
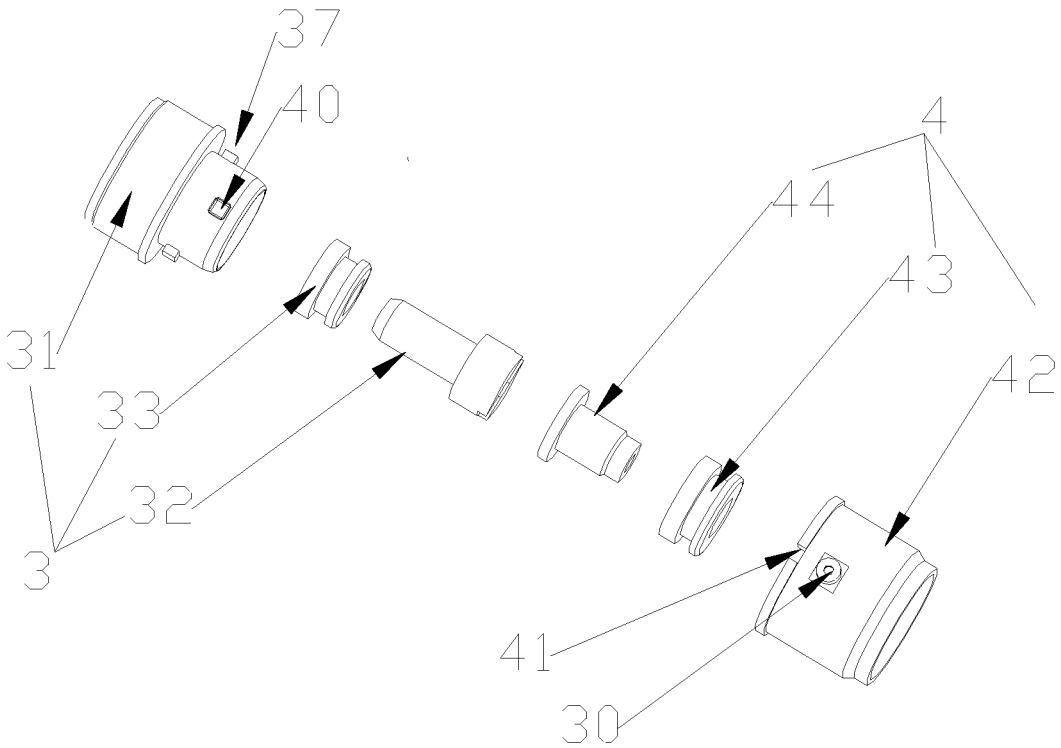
FIG. 10 is an exploded view of a connection structure of the electronic cigarette shown in FIG. 9.

Referring to FIG. 10, the first connection member 3 includes a first outer electrode 31, a first insulating member 33, and a first inner electrode 32. The connection and limiting relations between adjacent ones of the first outer electrode 31, the first insulating member 33, and the first inner electrode 32 are the same as that of the first embodiment, and do not need to be described here. The second connection member 4 includes a second outer electrode 42, a second insulating member 43, and a second inner electrode 44. The connection and limiting relations between adjacent ones of the second outer electrode 42, the second insulating member 43, and the second inner electrode 44 are the same as that of the first embodiment, and do not need to be described here.

Figure 11:
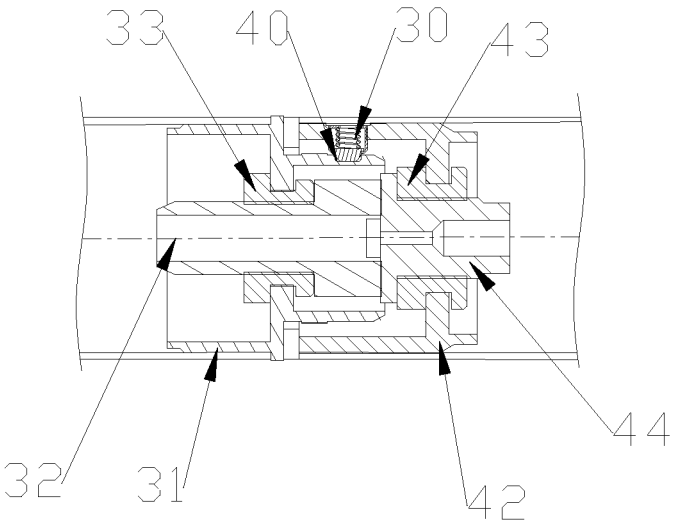
FIG. 11 is a cut-away view of the connection structure shown in FIG. 10.

Referring to FIG. 11, it can be seen from the cut-away view of the connection structure of the second embodiment that, after the atomizer assembly 1 is connected with the battery assembly 2, the first inner electrode 32 abuts the second inner electrode 44, the first outer electrode 31 abuts the second outer electrode 42, and the elastic member 30 is accommodated in the buckle slot 40.

Figure 12:
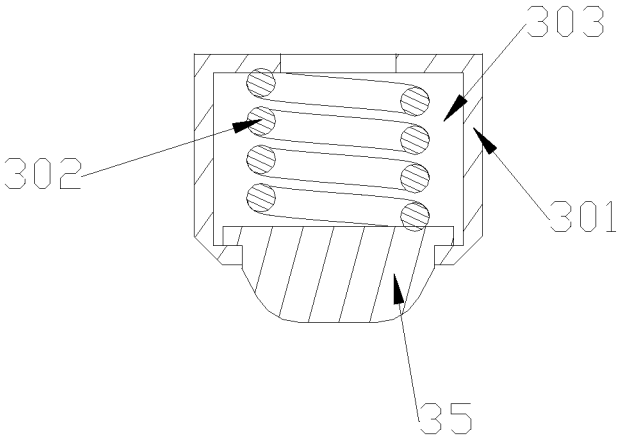
FIG. 12 is a schematic view of an elastic member of the connection structure shown in FIG. 11.

Referring to FIG. 12, the elastic 30 includes a fixed sleeve 301 and the bulge 35. The bulge 35 is partially sheathed in the fixed sleeve 301 and is movably connected to the fixed sleeve 301. The bulge 35 can move along at least one radial direction of the electronic cigarette. In order to disconnect the first connection member 3 from the second connection member 4 conveniently, in the second embodiment, the bulge 35 has a curved outer surface. When taking the first connection member 3 out from the joint slot, the first connection member 3 is further rotated, and the bulge 35 is pressed by the buckle slot 40. The bulge 35 having the curved outer surface is then pressed and deformed, and thus the bulge 35 departs from the buckle slot 40 with the rotation operation, which facilitates the first connection member 3 to be taken out from the joint slot.

Advantageously, the bulge 35 and the fixed sleeve 301 cooperatively form a receiving cavity 303. A spring 302 is inserted in the receiving cavity 303. One end of the spring 302 abuts the bulge 35, and the other end of the spring 302 abuts the fixed sleeve 301. The spring 302 is configured to apply an elastic force to the bulge 35 along a radial direction of the electronic cigarette.

It should be understood that the elastic member 30 of the second embodiment can also be mounted at an outer side of the first outer electrode 31 of the first connection member 3, for example, the elastic member 30 can be mounted at a portion of the outer side of the first outer electrode 31 aligned with the buckle convex block 37. Correspondingly, the buckle slot 40 may be defined in a corresponding portion of an inner side wall of the joint slot. When the atomizer assembly 1 is connected with the battery assembly 2, the buckle convex block 37 and the elastic member 30 are inserted into the joint slot along the guiding slot 41, and both the buckle convex block 37 and the elastic member 30 are fixed in the joint slot after being rotated.

Figure 13:
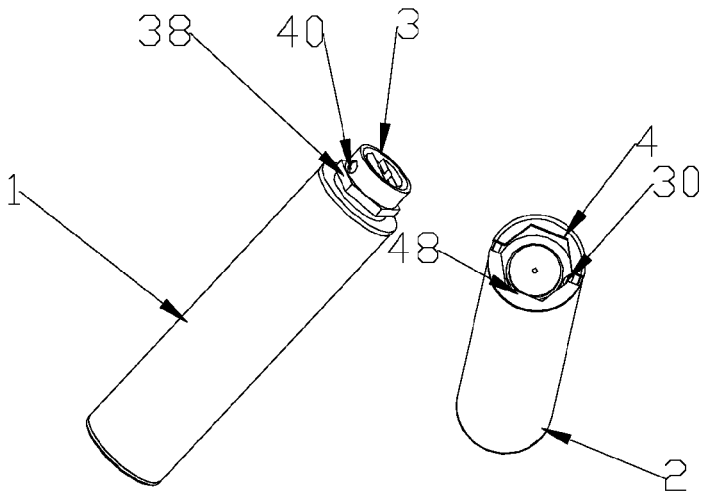
FIG. 13 is a disassembled structural schematic view of an electronic cigarette of a third embodiment of the present application.
Figure 14:
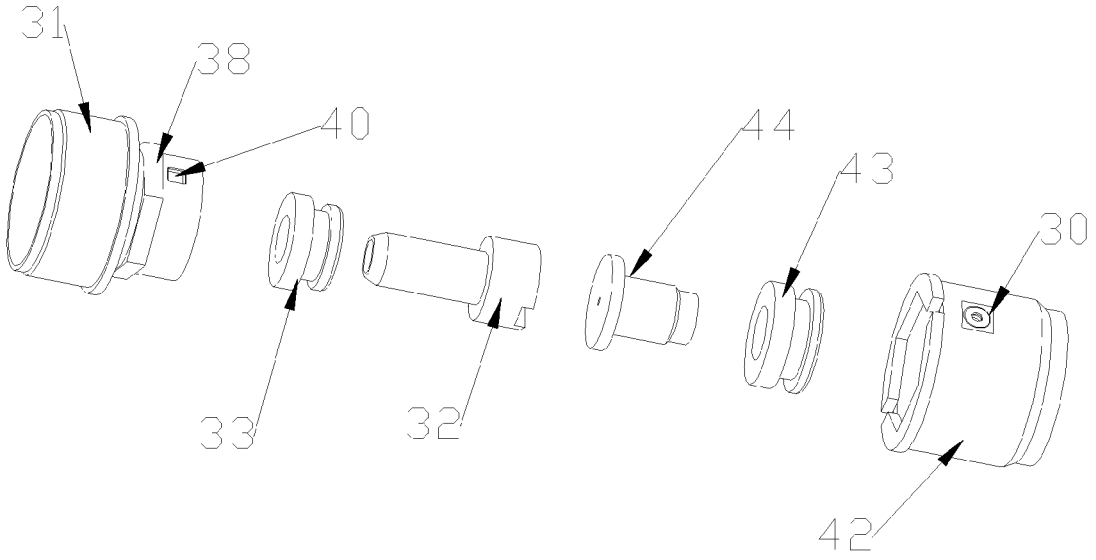
FIG. 14 is an exploded view of the connection structure of the electronic cigarette shown in FIG. 13.

Referring to FIGS. 13-14, an electronic cigarette in accordance with a third embodiment of the present application is shown. Different from the second embodiment, in the third embodiment, a buckle ring 38 is formed on an outer side wall of the first connection member 3. The buckle ring 38 is positioned at a side of the buckle slot 40 which is away from the second connection member 4. Corresponding to the buckle ring 38, a guiding surface 48 matched with the shape of the buckle ring 38 is formed on an opening end of the second outer electrode 42. Advantageously, the buckle ring 38 is noncircular. That is, in at least two directions, the lengths of the buckle ring 38 are different. For example, the buckle ring 38 may be oval, hexagonal, square, and any other regular or irregular shapes. When the atomizer assembly 1 is connected with the battery assembly 2, the buckle ring 38 is inserted into the joint slot along the guiding surface 48, and the buckle ring 38 is rotated and then limited by the limiting step 49. Meanwhile, in the rotation process, the elastic member 30 in the joint slot is pressed and deformed by the outer side wall of the first outer electrode 32. When the elastic member 30 is rotated to reach the buckle slot 40, the elastic member 30 restores from the deformation. At this time, the elastic member 30 impacts the inner wall of the buckle slot 40 to generate an indicating sound, and the elastic member 30 is accommodated in the buckle slot 40.

It should be understood that the buckle convex block 37 or the buckle ring 38 can also be formed on the first outer electrode 31 of the first embodiment, and the annular elastic piece of the first embodiment can also be applied to the second embodiment and the third embodiment.

Above all, in the present application, the elastic member 30 radially protruding outward from the first connection member 3 or protruding inward from the second connection member 4 is provided, and the bulge 35 is formed on the elastic member. Furthermore, the buckle slot 40 is defined in an outer side wall of the first connection member 3 or in an inner side wall of the second connection member 4. The position of the bulge 35 corresponds to the position of the buckle slot 40. When the atomizer assembly 1 is connected with the battery assembly 2, the first connection member 3 is rotated to press and deform the bulge 35. When the bulge 35 enters the buckle slot 40, the bulge 35 restores from the deformation and impacts the buckle slot 40 to generate an indicating sound. The indicating sound can enable the user to be aware of the connecting state between the first connection member 3 and the second connection member 4, and thus an insecure connection caused by over-rotating or under-rotating operations applied by the user can be avoided. Besides, with the present application, the connecting operation saves time and effort, and the product has a simple structure and a secure and convenient connection.

While the embodiments of the present application have been described with reference to the drawings, the present application will not be limited to above embodiments that are illustrative but not limitative. It will be understood by those skilled in the art that various changes and equivalents may be substituted in the light of the present application without departing from the scope of the present application, and those various changes and equivalents shall fall into the protection of the application.

What is claimed is:

1. An electronic cigarette, comprising an atomizer assembly and a battery assembly; a connection structure for connecting the atomizer assembly with the battery assembly mounted at a joint between the battery assembly and the atomizer assembly; the connection structure including a first connection member and a second connection member, and the first connection member connected with the second connection member;

wherein the second connection member defines a joint slot for receiving the first connection member; an elastic member is mounted on the first connection member or the second connection member, and the elastic member includes a bulge that radially protrudes inward from an inner wall of the joint slot or radially protrudes outward from the first connection member; correspondingly, a buckle slot matched with the bulge is defined in an outer side of the first connection member or is defined in the inner wall of the joint slot of the second connection member;

wherein the second connection member includes a jamming base, and the joint slot is defined in the jamming base; at least one guiding slot configured to receive the bulge is defined in one side wall of the jamming base; a first step is formed on an inner wall of the jamming base, and the first step is positioned adjacent to the guiding slot and protrudes from the inner wall of the jamming base; the first step and the inner wall of the jamming base cooperatively form the buckle slot the first step includes a first step plane positioned adjacent to the guiding slot;

when the atomizer assembly is connected with the battery assembly, the first connection member is inserted into the joint slot and is rotated to press and deform the bulge; and when the bulge is rotated to enter the buckle slot, the bulge slides along the first step plane and crosses the first step plane to impact an inner wall of the buckle slot to generate an indicating sound and is then buckled in the buckle slot.

2. The electronic cigarette according to claim 1, wherein, the jamming base has an opening end, and a diameter of the opening end contracts inward to form a limiting step; the limiting step is configured to limit an axial location of the bulge.

3. The electronic cigarette according to claim 1, wherein, the jamming base defines at least two guiding slots, and a second step is formed between two adjacent ones of the guiding slots; the second step includes a second step plane inclining to the same inclining direction as the first step plane; and the first step, the second step, and a portion of the inner wall of the jamming base between the first step and the second step cooperatively form the buckle slot.

4. The electronic cigarette according to claim 3, wherein, a side surface of the second step which is opposite to the second step plane is coplanar with a side surface of the guiding slot which is away from the first step.

5. The electronic cigarette according to claim 1, wherein, the buckle slot is a concave spot.

6. The electronic cigarette according to claim 1, wherein, the elastic member mounted on the first connection member is an elastic piece with an annular structure, and the bulge is a ridge radially protruding outward from the elastic piece; and when the first connection member is inserted into the joint slot, the ridge is pressed to deform, and then impacts the inner wall of the buckle slot defined in the joint slot to generate the indicating sound.

7. The electronic cigarette according to claim 6, wherein, the first connection member includes a first outer electrode configured to enable the electrical connection between the atomizer assembly and the battery assembly; a first through hole configured to enable the ridge to stretch out is defined in one side wall of the first outer electrode; the elastic member is mounted inside the first outer electrode; and the ridge runs through the first through hole and protrudes from the outer side of the first outer electrode.

8. The electronic cigarette according to claim 7, wherein, a first inner electrode configured to enable the electrical connection between the atomizer assembly and the battery assembly is inserted in the first outer electrode; a first insulating member is disposed between the first inner electrode and the elastic member; and a diameter of an outer side wall of the first insulating member contracts to form an annular groove for mounting the elastic member.

9. The electronic cigarette according to claim 1, wherein, the elastic member is an elastic block fixed on and protruding from the outer side wall of the first connection member or the inner side wall of the second connection member.

10. The electronic cigarette according to claim 9, wherein, the elastic block includes a fixed sleeve and the bulge; and the bulge is partially sheathed in the fixed sleeve and is movably connected to the fixed sleeve.

11. The electronic cigarette according to claim 10, wherein, the bulge and the fixed sleeve cooperatively form a receiving cavity; a spring is inserted in the receiving cavity; one end of the spring abuts the bulge, and the other end of the spring abuts a bottom of the receiving cavity; and the spring is configured to apply an elastic force to the bulge along a radial direction of the electronic cigarette.

12. The electronic cigarette according to claim 6, wherein, a buckle convex block is formed on the outer side wall of the first connection member; the buckle convex block is positioned at a side of the elastic member which is away from the second connection member or a side of the buckle slot which is away from the second connection member; and the buckle convex block is inserted in the second connection member and is then limited within the joint slot after being rotated.

13. The electronic cigarette according to claim 9, wherein a buckle convex block is formed on the outer side wall of the first connection member; the buckle convex block is positioned at a side of the elastic member which is away from the second connection member or a side of the buckle slot which is away from the second connection member; and the buckle convex block is inserted in the second connection member and is then limited within the joint slot after being rotated.

14. The electronic cigarette according to claim 5, wherein, a buckle ring is formed on the outer side wall of the first connection member; the buckle ring is positioned at a side of the elastic member which is away from the second connection member or a side of the buckle slot which is away from the second connection member; a guiding surface matched with the shape of the buckle ring is formed on an opening end of the second connection member; the buckle ring is inserted in the joint slot via the guiding surface, and the bulge is received in the buckle slot and the buckle ring is buckled in the joint slot after the first connection member is rotated.

15. The electronic cigarette according to claim 9, wherein a buckle ring is formed on the outer side wall of the first connection member; the buckle ring is positioned at a side of the elastic member which is away from the second connection member or a side of the buckle slot which is away from the second connection member; a guiding surface matched with the shape of the buckle ring is formed on an opening end of the second connection member; the buckle ring is inserted in the joint slot via the guiding surface; and the bulge is received in the buckle slot and the buckle ring is buckled in the joint slot after the first connection member is rotated.

* * * * *